US005913993A

United States Patent [19]

Ortega et al.

[11] Patent Number: 5,913,993

[45] Date of Patent: Jun. 22, 1999

[54] NONWOVEN NYLON AND POLYETHYLENE FABRIC

[75] Inventors: Albert E. Ortega; R. Wayne Thomley, both of Pensacola, Fla.

[73] Assignee: Cerex Advanced Fabrics, L.P., Cantonment, Fla.

[21] Appl. No.: 08/782,201

[22] Filed: Jan. 10, 1997

[51] Int. Cl.[6] ..... D04H 3/16

[52] U.S. Cl. ..... 156/167; 156/180; 156/181; 156/296; 156/308.2; 156/308.4; 442/401

[58] Field of Search ..... 156/167, 180, 156/181, 296, 308.4, 308.2; 442/401

[56] References Cited

U.S. PATENT DOCUMENTS

| | | | |
|---|---|---|---|
| 5,108,827 | 4/1992 | Gessner | 428/219 |
| 5,229,191 | 7/1993 | Austin | 428/198 |
| 5,270,107 | 12/1993 | Gessner | 428/296 |
| 5,368,913 | 11/1994 | Ortega | 428/198 |
| 5,393,599 | 2/1995 | Quantrille et al. | 428/284 |
| 5,431,986 | 7/1995 | Ortega et al. | 428/198 |
| 5,484,645 | 1/1996 | Lickfield et al. | 428/198 |
| 5,652,041 | 7/1997 | Buerger et al. | 428/198 |
| 5,662,978 | 9/1997 | Brown et al. | 428/57 |

FOREIGN PATENT DOCUMENTS

| | | |
|---|---|---|
| 0305116 | 3/1989 | European Pat. Off. . |
| 0421649 | 4/1991 | European Pat. Off. . |
| 1081347 | 8/1967 | United Kingdom . |

*Primary Examiner*—James J. Bell

*Attorney, Agent, or Firm*—Saliwanchik, Lloyd & Saliwanchik

[57] ABSTRACT

The invention relates to a nonwoven fabric made from a nylon and polyethylene blend. The addition of polyethylene enhances specific properties such as softness, lower production cost, improved process capabilities, and ease of further downstream processing such as bonding to other fabrics or itself.

5 Claims, No Drawings

NONWOVEN NYLON AND POLYETHYLENE FABRIC

FIELD OF THE INVENTION

This invention relates to a nonwoven fabric made from a nylon and polyethylene blend. The addition of polyethylene enhances specific properties such as softness, lower production cost, improved process capabilities, and ease of further downstream processing such as bonding to other fabrics or itself.

BACKGROUND OF THE INVENTION

Nonwoven fabrics and numerous uses thereof are well known to those skilled in the textiles art. Such fabrics can be prepared by forming a web of continuous filament and/or staple fibers and bonding the fibers at points of fiber-to-fiber contact to provide a fabric of requisite strength. The term "bonded nonwoven fabric" is used herein to denote nonwoven fabrics wherein a major portion of the fiber-to-fiber bonding referred to is adhesive bonding accomplished via incorporation of adhesives in the web to "glue" fibers together or autogenous bonding such as obtained by heating the web or by the use of liquid or gaseous bonding agents (usually in conjunction with heating) to render the fibers cohesive. In effecting such bonding, particularly autogenous bonding, the web may be subjected to mechanical compression to facilitate obtaining adequate bonding.

Spunbonded nonwoven fabrics formed of nylon 6,6 are widely used commercially for a number of purposes. Such fabrics exhibit excellent strength and permeability properties and accordingly are desirable for use in construction fabrics, filtration material, and furniture and bedding backing materials.

The fabrics are produced via the well-known spunbonding process in which molten nylon 6,6 is extruded into filaments, and the filaments are attenuated and drawn pneumatically and deposited onto a collection surface to form a web. The filaments are bonded together to produce a strong, coherent fabric. Filament bonding is typically accomplished either thermally or chemically, i.e., autogenously. Thermal bonding is accomplished by passing the web of filaments between the nip of a pair of cooperating heating calender rolls. In autogenous bonding, the web of filaments is transported to a chemical bonding station or "gas house" which exposes the filaments to an activating agent (i.e., HCl) and water vapor. Water vapor enhances the penetration of the HCl into the filaments and causes them to become tacky and thus amenable to bonding. Upon leaving the bonding station, the web passes between rolls which compact and bond the web. Adequate bonding is necessary to minimize fabric fuzzing (i.e., the presence of unbonded filaments) and to impart good strength properties to the fabric. Autogenous bonding has been especially used in forming spunbonded nylon 6,6 industrial fabrics.

Nonwoven fabrics which are strongly bonded overall (for example, by uniform compression of the entire web in the presence of heat and/or appropriate bonding agents) tend to be stiff and boardy and are frequently more similar to paper than to woven textile fabrics. In order to obtain softer nonwoven fabrics more closely simulating woven fabrics, nonwoven "point-bonded" fabrics have been prepared by processes which tend to limit bonding to spaced, discrete areas or points. This is accomplished by application or activation of an adhesive or bonding agent and/or application of heat and/or pressure at the points where bonding is desired. For example, the web to be bonded can be compressed between a pair of rolls or platens, at least one of which carries bosses or a land and groove design sized and spaced to compress the web at the desired points. The compression device can be heated to effect thermal bonding of the web fibers or to activate a bonding agent applied to the web. In the actual practice of preparing point-bonded fabrics, however, it is frequently difficult or even impossible to limit bonding to the desired points. In many processes, web areas between the desired bond points are subjected to sufficient heat, compression, activated bonding agent, or adhesive to effect "tack" bonding of fibers outside the desired bond points. Such tack bonding is believed to contribute significantly to undesired fabric stiffness.

It has been found that most point-bonded nonwoven fabrics, particularly those having a large number of tack bonds, and many overall bonded nonwoven fabrics can be significantly softened by subjecting the fabric to mechanical stress. For example, the fabric can be washed in conventional domestic washing machines, drawn under tension over a sharply angled surface such as a knife blade, stretched, twisted, crumpled, or subjected to various combinations of such treatments. Such treatments are believed to effect softening primarily by breaking weaker fiber-to-fiber bonds such as tack bonds which can be broken without breaking the point- or intentionally-bonded fibers. These methods are relatively effective but subject to certain practical problems. For example, drawing a nonwoven fabric over a knife blade with sufficient force to effect substantial softening frequently results in an undesirably high level of physical damage to the fabric. Washing of nonwoven fabrics generally yields good results, but is a batch operation not typically adaptable for use in continuous processes of the type employed commercially for production of nonwoven fabrics.

Another method for softening nonwoven fabrics is by impinging the fabric with a fluid jet. This is, however, an additional and potentially cumbersome production step, resulting in increased manufacturing costs.

It is apparent that a commercially practical process for a simpler, more cost-effective method for the softening of nonwoven fabrics would satisfy a long-felt need in the nonwoven textile art.

BRIEF SUMMARY OF THE INVENTION

The subject invention concerns an improved process for producing a nonwoven nylon fabric with improved characteristics. Specifically, the subject invention provides a process for softening nonwoven spunbonded fabrics. In a preferred embodiment, the production of a nonwoven nylon 6,6 fabric is improved by adding polyethylene to the nylon 6,6 material used in producing the fabric. An important advantage of the process of the subject invention is that it provides a softer hand or "feel" to the filaments and fabric made therefrom. In addition, the subject invention provides enhanced water repellency characteristics of the nonwoven fabric. The process also offers a lower cost polymer for processing along with the nylon polymer.

DETAILED DISCLOSURE OF THE INVENTION

In accordance with the present invention, a small amount of polyethylene polymer is blended with a nylon compound used to form a nonwoven fabric with desirable characteristics. The addition of polyethylene to nylon enhances specific properties such as softness. The use of polyethylene also lowers cost of production, and eases further downstream processing such as bonding to other fabrics or itself.

In the following detailed description of the preferred embodiments of the invention, specific terms are used in describing the invention; however, these are used in a descriptive sense only and not for the purpose of limitation. It will be apparent that the invention is susceptible to numerous variations and modifications within its spirit and scope.

The present invention concerns a process to produce a spunbonded nonwoven fabric with the properties of a softer hand. The subject invention further concerns the fabric produced according to the subject process. This fabric comprises a polyethylene component which is easier to bond thermally or ultrasonically to fabrics made from lower melt point polymers. A lower cost polymer can thus be utilized for processing along with the nylon polymer. A further aspect of the subject invention is the enhanced water repellency characteristic of the fabric produced by the subject process.

The improved fabric is obtained in accordance with the present invention by adding a small amount of polyethylene to the nylon feed material used in producing a spunbond fabric. More specifically, the fabric of the subject invention can be produced by forming a blend of polyethylene and nylon 6,6, extruding the blend in the form of a plurality of continuous filaments, directing the filaments through an attenuation device to draw the filaments, depositing the filaments onto a collection surface such that a web is formed, and bonding the filaments together either autogenously or thermally to form a coherent, strong fabric.

The polyethylene useful in the process of the subject invention preferably has a melt index between about 5 grams/10 min and about 200 grams/10 min and, more preferably, between about 17 grams/10 min and about 150 grams/10 min. The polyethylene should preferably have a density between about 0.85 grams/cc and about 1.1 grams/cc and, most preferably between about 0.93 grams/cc and about 0.95 grams/cc. Most preferably, the melt index of the polyethylene is about 150 and the density is about 0.93.

The polyethylene used in the process of the subject invention can be added at a concentration of about 0.05% to about 20%. In a preferred embodiment, the concentration of polyethylene will be between about 0.1% and about 1.2%. Most preferably, the polyethylene will be present at about 0.5%. The concentration of polyethylene in the fabric produced according to the method of the subject invention will be approximately equal to the percentage of polyethylene added during the manufacturing process. Thus, the percentage of polyethylene in the fabrics of the subject invention will typically range from about 0.05% to about 20% and will preferably be about 0.5%. Therefore, the fabric will typically comprise between about 80 and about 99.95 percent by weight of nylon. The filament extrusion step can be carried out between about 250° C. and about 325° C. Preferably, the temperature range is about 280° C. to about 315° C., but may be lower if nylon 6 is used.

The blend or copolymer of polyethylene and nylon can be formed in any suitable manner. Typically, the nylon compound will be nylon 6,6; however, other polyamides of the nylon family can be used. Also, mixtures of nylons can be used. In one specific example, polyethylene is blended with a mixture of nylon 6 and nylon 6,6. The polyethylene and nylon polymers are typically supplied in the form of pellets, chips, flakes, and the like. The desired amount of the polyethylene pellets or chips can be blended with the nylon pellets or chips in a suitable mixing device such as a rotary drum tumbler or the like, and the resulting blend can be introduced into the feed hopper of the conventional extruder or the spunbonding line. The blend or copolymer can also be produced by introducing the appropriate mixture into a continuous polymerization spinning system.

The filaments produced during the process of the subject invention may be bonded chemically or thermally. In one embodiment, HA gas and water vapor can be applied to achieve bonding. In another embodiment, the filaments may be heated to, for example, between 180° C. and about 250° C. Preferably, the filaments are heated to between about 200° C. and 235° C.

The following examples serve to illustrate the invention but are not intended to be limitations thereon.

EXAMPLE 1

Samples of a polyethylene/nylon 6,6 spunbonded fabric can be prepared as described below. Solid pellets of polyethylene can be added to a line producing nylon 6,6 fabric. Linear low density polyethylene, grade 6831, known by the trademark ASPUN, marketed by Dow Chemical, U.S.A., can be used in the process. In one example, approximately 0.5% experimental linear low density polyethylene was added to nylon 6,6 polymer to produce fabric at 1 ounce per square yard basis weight. The mixture was melted and extruded at a temperature of about 300° C. The melt was spunbonded into continuous filaments and deposited onto a forming wire. The resulting web was then directed to a chemical bonding station where the web filaments were bonded using HCl gas and water vapor at a temperature of about 39° C. The fabric is produced by chemically bonding filaments together in a gas house. The web was then subjected to a roll treatment in which the web was compacted and further bonded.

The body quality of the fabric with the polyethylene did not differ appreciably from that without the polyethylene. Furthermore, process pressures on the extruder, filters, and packs did not change significantly. Spinning performance was similar to that in the routine process.

Addition of the polyethylene produced a softer fabric. The throughput was increased approximately 8% near the limitation of the meter pump drive system with no incident.

EXAMPLE 2

Two samples of a polyethylene/nylon 6,6 spunbonded fabric were prepared as described in Example 1 above except that 0.6% and 1.2% linear low density polyethylene were added to nylon 6,6 polymer along with 2.3% and 4.7% nylon 6, respectively. Nylon 6 known by the trademark Capron, marketed by Allied, can be used. The mixture was melted and extruded at a temperature of about 300° C. The melt was spunbonded into continuous filaments and deposited onto a forming wire. The resulting web was then directed to a calender where the web filaments were thermally bonded at a temperature of about 216° C.

The body quality of the fabric with the polyethylene did not differ appreciably from that without the polyethylene. Furthermore, process pressures on the extruder, filters, and packs did not change significantly. Spinning performance was similar to that in the routine process.

EXAMPLE 3

A fabric can be prepared comprising nylon 6,6, nylon 6, and polyethylene. The fabric can comprise about 0.1% to about 10% nylon 6 and about 0.05% to about 20% polyethylene, balance nylon 6,6. More specifically, it may comprise about 1% to about 2% nylon 6 and about 0.1% to about 1% polyethylene, balance nylon 6,6.

It should be understood that the examples and embodiments described herein are for illustrative purposes only and that various modifications or changes in light thereof will be suggested to persons skilled in the art and are to be included within the spirit and purview of this application and the scope of the appended claims.

We claim:

1. A method of producing a nonwoven fabric comprising the steps of forming a blend of a nylon compound and polyethylene, extruding said blend in the form of a plurality of filaments, depositing the filaments onto a collection surface to form a web, and bonding the filaments of the web, wherein said process comprises subjecting the blend to a temperature of between about 250° C. and about 325 ° C. and wherein said blend comprises about 0.1 to about 1.2 percent by weight polyethylene.

2. The method, according to claim 1, wherein said step of forming a blend comprises blending about 0.1 to about 1.2 percent by weight polyethylene and about 98.8 to about 99.9 percent by weight nylon 6,6.

3. The method, according to claim 1, wherein the step of bonding said filaments comprises forming autogenous bonds at cross-over points of said filaments within said web.

4. The method, according to claim 1, wherein the step of binding said filaments comprises forming thermal bonds at discrete points throughout the fabric.

5. A method of producing a spunbonded nonwoven fabric comprising the steps of blending 0.1 to 1.2 percent by weight of polyethylene with solid granular nylon 6,6, heating the blend of polyethylene and nylon in the barrel of an extruder to a temperature between about 250° C. and about 325° C. to form a blend of the polyethylene and nylon 6,6, extruding said blend to form a plurality of continuous filaments, directing the filaments into and through a pneumatic attenuator device and pneumatically attenuating and drawing the filaments, depositing the filaments onto a collection surface to form a web, and bonding the filaments of the web to form a nonwoven fabric.

* * * * *

UNITED STATES PATENT AND TRADEMARK OFFICE

CERTIFICATE OF CORRECTION

PATENT NO. : 5,913,993
DATED : June 22, 1999
INVENTOR(S) : Albert E. Ortega and R. Wayne Thomley It is certified that error appears in the above-identified patent and that said Letters Patent is hereby corrected as shown below:

Column 4,
Line 7, "HA gas" should read -- HCl gas --.

Signed and Sealed this

Thirty-first Day of December, 2002

JAMES E. ROGAN
*Director of the United States Patent and Trademark Office*